United States Patent [19]

Stapp

[11] 4,012,249

[45] Mar. 15, 1977

[54] REINFORCED MATTING AND A PROCESS AND APPARATUS FOR ITS PRODUCTION

[75] Inventor: Hans Stapp, Momlingen, Germany

[73] Assignee: Akzona Incorporated, Asheville, N.C.

[22] Filed: July 3, 1975

[21] Appl. No.: 593,054

[30] Foreign Application Priority Data

July 3, 1974 Germany ..... 2431871

[52] U.S. Cl. ..... 156/167; 156/178; 156/244; 156/436; 156/500; 264/176 F; 264/273; 428/110; 428/236; 428/247; 428/255; 428/256

[51] Int. Cl.[2] ..... D04H 3/16

[58] Field of Search ..... 156/167, 182, 181, 244, 156/500, 72, 176–178, 436, 306, 180; 264/178 F, 176 F, 168, 271, 273, 281, 282, 257, 258; 428/371, 369, 297, 296, 110, 255, 256, 236, 247

[56] References Cited

UNITED STATES PATENTS

| | | | |
|---|---|---|---|
| 2,900,700 | 8/1959 | Frickert | 156/181 |
| 3,449,187 | 6/1969 | Bobcowicz | 156/244 |
| 3,658,632 | 4/1972 | Chandler et al. | 428/296 |
| 3,691,004 | 9/1972 | Werner et al. | 156/181 |
| 3,837,988 | 9/1974 | Hennen et al. | 156/167 |

*Primary Examiner*—Charles E. Van Horn
*Assistant Examiner*—Michael W. Ball
*Attorney, Agent, or Firm*—Johnston, Keil, Thompson & Shurtleff

[57] ABSTRACT

A reinforced matting of melt-spun, interlooped, substantially amorphous and continuous synthetic thermoplastic filaments of which one set of filaments is applied with random penetration to a flat, latticed structure such as a fabric mesh or wire screen while another set of filaments may be added to form at least one and preferably several additional rows of interlooped filaments adhered to the first set of filaments carried by the latticed structure as a reinforcing member. This matting is made in a specific process requiring the first set of filaments to be melt spun at an angle inclined from the vertical onto the reinforcing member as a vertically conducted continuous band while the second set of filaments may be waterlaid on the surface of a liquid cooling medium, and the resulting filaments are then collected at or just below the liquid surface for adherent interlooping contact with each other and are carried on the reinforcing member through the bath as the filaments are completely solidified into a coherent self-bonded matting of high longitudinal and transverse strength.

14 Claims, 7 Drawing Figures

A

REINFORCED MATTING AND A PROCESS AND APPARATUS FOR ITS PRODUCTION

The subject matter of the present invention is particularly related to the type of self-bonded matting composed of substantially amorphous filaments of a melt-spun synthetic polymer, preferably with a filament diameter of about 0.1 to 1.5 mm., as disclosed in U.S. Pat. Nos. 3,687,759 and No. 3,691,004, which are therefore incorporated herein by reference as fully as if set forth in their entirety. These earlier produced mattings are quite useful in providing resilient or elastic cushioning structures when made so as to provide helical to sinuous loops of filaments along parallel axes, i.e. with all of the loops extending in a relatively regular pattern or orientation in the nature of a series of overlapping coiled springs (see U.S. Pat. No. 3,691,004). By reorienting these loops through deformation along one surface, e.g. by contact with an inclined plate extending into the bath, it has been possible to produce another series of products including artificial ski slops and a matting for transporting a freshly grown sod or turf (see U.S. Pat. No. 3,691,004).

Many other utilities have also been suggested including upholstery mats, cleaning and scrubbing aids, protective mats, filter materials or drainage mats in both vertical and horizontal drainage systems, e.g. in water treatment, gardening and playground applications, stabilizing mats for transporting liquid containers, sedimentary and retaining mats for hydraulic projects, connecting or joining means in building construction (multi-layer building panels, concrete casings or backings, plaster finishing panels, etc.) and stiffening or strengthening mats for floors which are heavily loaded statically or dynamically.

Also, preliminary tests using these resilient mattings for the retention or anchoring of sloped or banked areas, e.g. along roadways or new canal construction, have given very promising results. The matting is ordinarily staked in place on the slope and then filled with earth (especially for rocky slopes), preferably admixing grass and/or plant seeds and fertilizer with the earth. In this manner a bare slope is easily and completely "greened" within a relatively short period of time.

For very steep slopes and banks, it is necessary to increase the tear or breaking strength of such mattings after their initial production, and attempts have been made to do this by impregnation with a water-insoluble binder or bonding agent. Although this additional binder improves the strength of the matting as desired, it is too expensive as a process technique because it requires additional steps of dipping or coating with the binder, drying and usually a thermal aftertreatment. All of these steps are necessary to solidfy the impregnated binder and strengthen the matting. Even then, it is difficult to achieve a sufficiently high strength of the matting to be used under the most extreme conditions, i.e. on steep slopes having a rock base in regions of high rainfall.

It is also known that single and multi-layer fibrous fleeces or webs can be strengthened by needling operations or by the application of heat and/or pressure, and fabric reinforcements may be used to hold the fleece or web in place as well as contributing to the overall strength or resistance to tearing. However, such added steps or materials are generally quite expensive and require additional space and equipment as well as more time and handling of the fibrous materials.

It is an object of the present invention to provide a reinforced matting comprising interlooped, amorphous, continuous synthetic filaments which are self-adherent and applied to a flat, latticed structure without any need to use binders, impregnating agents or similar bonding materials. The process of the invention has the object of creating such a matting in a single operation, relying essentially on the self-adherent properties of the meltspun thermoplastic filaments to achieve a special mat construction having a strength sufficient to handle high loads without tearing or rupturing. The resulting product is preferably one having a plurality of distinctly formed layers with the object of achieving a wide variety of mattings useful for different purposes. It is also an object of the invention to provide apparatus especially adapted to yield the desired reinforced matting but offering great flexibility in the use of different filamentary materials and in preparing various multi-layer products.

In accordance with the invention, these and other objects and advantages of the invention are achieved above all by a process comprising the steps of conducting a continuous band of a flat, latticed structure as a reinforcing member downwardly into and then through a bath of a liquid cooling medium, simultaneously melt-spinning a plurality of thermoplastic polymer filaments downwardly toward said bath to form interlooped filaments adhering to each other at random overlapping points of intersection, the spinning taking place from at least two rows of spinning orifices disposed adjacently on one or either side of said reinforcing member, applying at least part of the freshly spun filaments onto the reinforcing member by directing adjacent filaments at an angle inclined from the vertical direction to impinge upon and randomly penetrate this reinforcing member above the bath surface, and completely solidifying the freshly spun filaments only after their entry into said cooling medium such that in a bath zone near the surface of the cooling medium the filaments remain sufficiently tacky to adhere to each other at their overlapping points of intersection.

It is of particular advantage for purposes of the present invention to provide filaments which are melt-spun from at least three rows of spinning orifices, including said two rows disposed adjacently on either side of said reinforcing member and at least one additional row spun vertically downwardly for direct deposit onto the bath surface, the upward buoyant force of the liquid cooling bath being sufficient to cause said filaments in said at least one additional row to spread laterally at the bath surface in the form of simuous to helical loops overlapping each other with reference to adjacent filaments in at least the same row, the filaments of said at least one additional row being collected in said bath zone near the surface of the cooling medium for adherent contact with each other and with said filaments already applied to said reinforcing member.

By following the methods used in the earlier teaching of U.S. Pat. No. 3,691,004 which also defines the terms "substantially amorphous" as applied to the filaments as well as the "buoyant force" to explain the special loop formation at the bath surface, it is possible to direct the at least one additional row of sinuously to helically looped filaments for collection onto a guide plate arranged in an inclined position in the bath to deform at least one outermost row of filaments so that the individual loops therein project substantially parallel to the reinforcing member.

With additional rows of sinuously to helically looped filaments on each side of the reinforcing member, a relatively thicker matting can be achieved with a relatively open structure of loops oriented at about 90° to the plane of the reinforcing member, or with one flattened surface where the guide plate serves to reorient the loops of an outermost row into a plane parallel to that of the reinforcing member.

The essential structure of the matting according to the invention resides in the provision of the latticed flat sheet or web, i.e. a filamentary net or mesh material, which is incorporated into the matting by a part of the filaments randomly penetrating is so as to maintain interlooped, self-adherent filaments in direct connection through the latticed material. The penetration of the latticed sheet or web as the basic reinforcing member follows a random pattern in that some filaments penetrate from one side and some from the other side in randomly alternate directions and to randomly different depths of penetration. The result is an entanglement or irregular crossover of filamentary loops from both sides of the reinforcing member so that it is effectively spun into the matting.

The term "interlooped" is employed herein to define any regular or irregular arcing, curling, waving, coiling or similar variation from a straight filament such that filaments from one row overlap with those of another row, thereby providing points of intersection where self-bonding can occur while the freshly spun filaments are at least warm and tacky. By comparison, the phrase "sinuously to helically looped" as applied to the filaments directly spun onto the surface of the cooling bath represent a much more regular coiling or looping including at least some helical coils as well as at least some sinuous loops. With filaments of the same diameter, especially nylon or polyethylene terephthalate filaments of about 0.1 to 1.5 mm. one can spin them directly down onto the surface of a cooling water bath, e.g. from a height of about 2 to 30 cm., so as to form a relatively uniform helical coil with more sinuous loops becoming noticeable as the helical coil is pulled out through the bath. As these regular loops are deformed or reoriented to become parallel with the upper or lower surfaces of the mat, they create a denser structure of lower resiliency or elasticity. By retaining at least some filaments with the original sinuous to helical loop formation, the mat provides an open, less dense structure of better resiliency.

The present invention permits these variations in the mat structure to be made to order based upon the number of additional rows of sinuously to helically looped filaments which are directly adhered to the interlooped filaments directly adjacent to and randomly penetrating the latticed reinforcing member.

The invention is set forth in greater detail hereinafter together with the accompanying drawing in which:

FIG. 1 is a partly schematic top view of a length of reinforced matting made in accordance with the invention;

FIG. 2*a*, 2*b* and 2*c* are perspective views, partly schematic, of small segments of different latticed flat materials used as the reinforcing member of the matting accordingly to the invention;

Figures 1, 2A, 2B, 2C, 3, 4, 5:
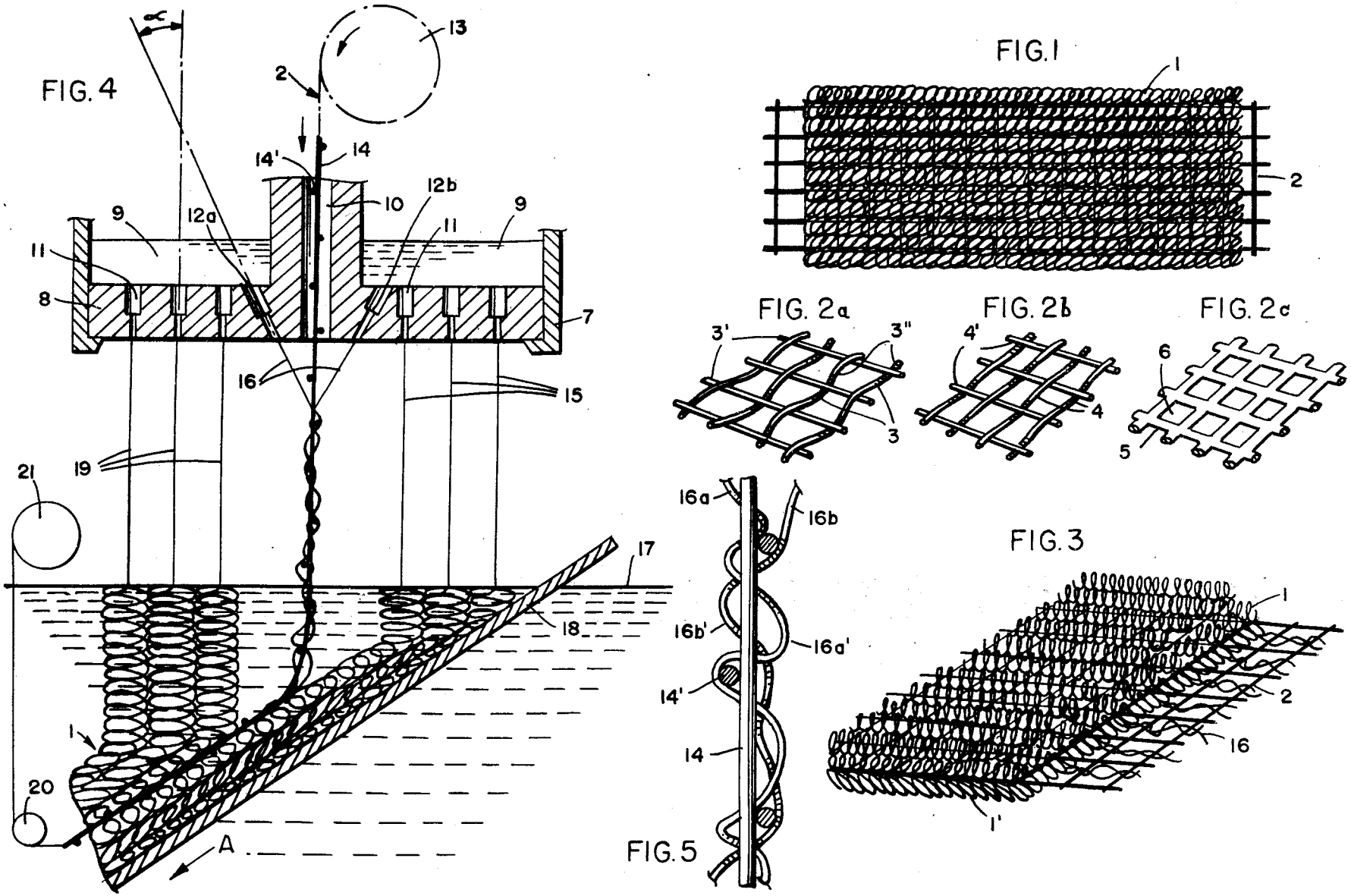
FIG. 3 is another partly schematic and partial perspective view of the reinforced matting of FIG. 1, slightly enlarged to illustrate more details of the composite structure.
FIG. 4 is a schematic view of suitable apparatus for producing the reinforced matting of the invention, including a partial sectional view taken through a special spinning head.
FIG. 5 is an enlarged view of a short length of the reinforcing member of FIG. 4 as located above the bath after penetration with freshly spun filaments.

A resilient matting 1 of interlooped and self-adherent rows of continuous amorphous fiber-forming polymer filaments is generally shown from above in FIG. 1 and these rows of looped filaments are applied both above and below the reinforcing mesh or screen 2. Details of the various layers of looped filaments are omitted from FIG. 1 other than to indicate that at least the outer, relatively open, sinuously to helically looped layers of the matting 1 are slightly wider than the reinforcing member 2, for example by about one row of these looped filaments on each side.

The reinforcing member 2 is by definition of substantially greater strength than the looped filamentary structure of the matting 1 and is generally a latticed flat structure such as a mesh, screen, net or the like exhibiting openings sufficiently large to permit penetration of the mesh by at least part of the freshly spun filaments in rows directly adjacent the reinforcing member. One can readily select a wide variety of materials for this reinforcing member, e.g. loosely set and large meshed woven fabrics or knit structures, similar woven nets of textile monofilaments or multi-filament threads fastened by a binder or the like at points of intersection, or other types of textile-like structures having maximum flexibility with adequate tensile strength of the individual filaments or threads. Also, it is possible to use reinforcing metal screens commonly used in building construction and of relatively heavy or stiff construction with very large mesh openings or else one may select a finer woven wire screen with a smaller mesh structure still large enough to be penetrated by freshly spun thermoplastic filaments. Premolded or heat-set plastic screens or webs of various configurations are also useful.

In FIGS. 2*a*, 2*b* and 2*c*, a number of typical reinforcing members are illustrated, including woven textile threads in a plain weave of warp 3 and weft 3', which may be bonded or heat-set at the points of intersection 3'' as indicated in FIG. 2*a*. Filaments or threads of a high tensile strength fiber-forming polymer are quite useful, especially polyethylene terephthalate fibers. Such fibers can be in the form of twisted or untwisted staple fibers or continuous filament yarns.

A simple woven metallic screen consisting only of the warp 4 and weft 4' wires is shown in FIG. 2*b*, these wires being composed of any suitable metal such as copper, steel, galvanized iron or the like, i.e. especially corrosion- resistant metal wires including alloys or coated wires as well as individual corrosion resistant metals.

A molded or heat-formed plastic mesh web 5 is shown in FIG. 2*c* with slightly smaller openings 6 due to the flattened cross-section of the longitudinal and transverse plastic ribs. One can easily use waste plastic materials to form a strong reinforcing member in this case even though the resulting web is less flexible and bulkier than textile filaments. This type of structure has the advantage on the other hand that it may be preheated in forming the matting of the invention so as to provide adherence to the adjacent layers of looped filaments and especially those looped filaments penetrating the openings 6. Thus only a surface tackiness is necessary to achieve such additional bonding.

Metal screens or fabrics offer the highest tensile strength in both longitudinal and transverse directions with the widest possible variation in the mesh size, i.e. the width of the mesh openings (measured herein as the distance between adjacent parallel wires in the warp or the weft direction). For example, when using the preferred melt-spun and looped filaments having diameters of about 0.1 to 1.5 mm., the width of the reinforcing mesh openings can extend from about 1 to 100 mm., preferably about 5 to 50 mm. and especially between about 10 and 30 mm.

The term "flat latticed structure" is thus quite comprehensive in defining the reinforcing member 2 and the invention is not to be restricted to the illustrative embodiments shown in FIGS. 2*a*, 2*b* and 2*c*. Thus, it is also feasible to provide screens or webs with wires, filaments, ribs or the like in a diamond-shaped configuration or with triangular or hexagonal openings so that some or all of the filamentary structure extends on diagonal lines with reference to the longitudinal direction of the matting. In general, it is preferable to employ the illustrated screens or webs with the filamentary structure extending on the longitudinal and perpendicularly transverse directions of the matting.

An integral or coherent composite matting reinforced in accordance with the invention is schematically illustrated by FIG. 3 in which top layer 1 of sinuously to helically formed loops is joined to a similar bottom layer 1' in which these special loops are reoriented at least by 45° and preferably to 0° or parallel with the reinforcing member 2, thereby providing a denser and relatively flatter bottom or base surface for the matting. Both the top layer 1 and bottom layer 1' are self-adhered to another set of interlooped layers or rows of filaments 16 as shown in detail in FIGS. 4 and 5.

A specially designed spinning head together with other required apparatus is shown in FIG. 4 which will also serve to explain a preferred embodiment of the process of the invention which essentially incorporates methods and similar apparatus as taught in U.S. Pat. No. 3,691,004. In order to avoid undue repetition, the process and apparatus are explained herein to the extent it is necessary to modify the apparatus used in U.S. Pat. No. 3,691,004. Unless otherwise indicated, the apparatus elements herein are convention or known from the prior patent. It should be further understood that the process and apparatus of the present invention may also be combined with U.S. Pat. No. 3,687,759 or other known means of producing interlooped filamentary mats, particularly where one uses a vertical melt-spinning apparatus combined with a bath containing a cooling medium, preferably water.

Referring now to FIG. 4, the spinning head 7 is shown schematically in cross-section as having a rectangular nozzle plate 8 divided into two compartments 9 for the thermoplastic polymer melt which is maintained under a pressure p as supplied from a metering pump and conventional extruder (not shown). The spinning head has a central feed slot 10 extending therethrough in place of one row of spinning bores or nozzles. Conventional spinning nozzles 11 form three outer rows of filaments as shown while the spinning nozzles 12a and 12b are inclined on either side and directly adjacent to the feed slot 10 so as to spin or extrude the filaments 16 at an angle $\alpha$ taken with reference to the usual vertical spinning direction of the nozzles 11 from which the filaments 15 and 19, respectively, fall freely and directly down to the water bath surface 17, i.e. without interference from the reinforcing member 14 being fed continuously from the supply reel 13. It is also preferable to maintain the filaments 15 and 19 free of contact of the inwardly angled freshly spun filaments 16 as these are applied to the reinforcing member 14 in the free fall zone extending from the bottom of the nozzle plate 8 down to the bath surface 17.

Each row of spinning nozzles 11 and 12 can provide from about 20 to 200 spinning openings by way of example, preferably of the same size and substantially equally spaced in each row and with a uniform spacing between adjacent rows. In general, the interval between the nozzle openings can range from about 3 to 8 mm. depending upon the diameter of the filaments and the desired density of the matting. If desired, the spacing of the rows and size of filaments may also be varied over the base of the nozzle plate.

The angle $\alpha$ can vary between about 10° and 70° but is preferably between about 15° and 35°. In the present example, this angle is about 25°.

The distance of the nozzle openings 12*a* and 12*b* from the feed slot opening 10 should be kept as small as possible, consistent with a frequent penetration of the latticed reinforcing member 14 from both sides. Sufficient pressure p can be exerted to create a jet effect which will span the gap between the openings 12 and the slot 10, the angle $\alpha$ also being set to ensure that the jet has enough momentum to pass through the mesh openings of member 14 in a random manner from each side of the downwardly conducted reinforcing structure.

FIG. 5 provides an enlarged view of a segment of this reinforcing structure between the point of first contact of the two rows of filaments 16*a*, 16*b* and the bath surface 17. The warp filaments, strands or threads 14 are maintained in a substantially vertical path with the horizontal weft threads 14' alternating on either side or in a plain weave pattern as in FIGS. 2*a* and 2*c*. There is a frequent penetration of the freshly spun filaments to form loops 16*a'* and 16*b'* projecting partly through the reinforcing member and contacting the filaments applied from the opposite direction frequently enough to entangle or envelop the weft threads 14'. This reinforcing structure by itself is unique as a special means for subsequently adding other thermoplastic filamentary layes on one or both sides, especially if the penetrating and enveloping filaments 16 are composed of a relatively low melting point thermoplastic material, e.g. copolymers of polyethylene terephthalate of lower melting point than the homopolymer. In this case, these filaments 16 can act as a bonding agent as in more conventional multi-layer fleeces, but they are preferably combined immediately in a single continuous operation with one or more additional filamentary layers as in the illustrated embodiment of the present invention.

The outer three rows of filaments 15 and 19 begin to loop and spread laterally in helical to sinuous fashion just as they enter the bath surface and immediately overlap for self-adherence near the bath surface in a bonding zone of the bath preferably extending at least down to the point where all the filamentary layers are joined together by self-adherence, e.g. where the looped filaments 19 are collected on the upper surface of the reinforcing member 14 carrying looped filaments 16. The guide plate 18 serves to lay over the bottom row of loops of the right-hand row of spun filaments so as to be substantially parallel to the horizontal or longitudinal plane of the matting, this bending or reorientation of the bottom loops yielding a relatively flat base structure of higher density. For example, the second row of loops from the bottom could be closer to 45° while the third row reaches almost 90°, i.e. with loops almost perpendicular to the plate 18. The upper three rows of looped filaments may then also approach this 90° angle. Other variations in the position of these sinuously to helically shaped loops can also be achieved as noted in detail in U.S. Pat. No. 3,691,004. In fact, one can generally obtain the same type of matting as in this prior patent except for the newly incorporated reinforcing structure of continuous mesh band or web 14 through which filaments 16 are interlooped.

While the distance from the nozzle plate 8 to the bath surface may range between about 2 and 30 cm., it has been found that good results with amorphous poly-ε-caprolactam filaments are usually obtained at free fall distances of about 4 to 20 cm. for the outer sets of filaments 15 and 19. As the entire matting 1 is formed, it is drawn off in the direction of "A" around guide roller 20 and onto a take-up roll or winder 21. The speed at which the matting 1 is drawn off through the bath is adjusted so as to avoid pulling out the loops of filaments 15 and 19 while still tacky or deformable in the bonding zone or along plate 18, which may be internally heated if desired.

Any matting structure similar to that illustrated in FIGS. 3 and 4 can thus be produced in a single operation with a bottom lower densified layer of reoriented sinuous to helical loops 1' or 15 and a cover or upper porous layer 1 or 19 of sinuous to helical loops extending in a more or less perpendicular direction to the longitudinal plane of the matting. Both of these upper and lower layers 1 and 1' are then firmly self-adhered by interlooping with the filaments 16 which penetrate back and forth through the reinforcing member 2 or 14.

These particular mattings with at least two additional rows of sinuously to helically looped filaments 15 and/or 19, when combined with a reinforcing member 2 or 14 having a flat latticed structure penetrated by interlooped filaments 16, provides a relatively resilient or flexible matting with all of the structural variations otherwise to be found in U.S. Pat. No. 3,691,004. For its use as a protective or holding mat for sloping terrains, especially rocky slopes, banks or the like, it is preferably formed with loops lying horizontally or nearly horizontally on the bottom surface and firmly joined to the reinforcing member by the filaments spun therethrough. With more or less steeply projecting loops on the upper layer of the matting, large hollow or open spaces are provided and can be filled with topsoil or a mixture of topsoil and other ingredients such as fillers, seeds, fertilizer, etc., to provide a well anchored base for starting plant growth.

The foregoing description offers a preferred description of the matting in terms of a process and suitable apparatus without limiting the invention to these very useful embodiments. Thus, variations in the process are permissible as well as minor changes or substitution of equivalents in the apparatus without departing from the spirit or scope of the invention. The resulting reinforced mattings having very high values of strength for load bearing purposes will find a wide variety of uses in many different types of lightweight, flexible and porous filamentary structures.

EXAMPLE

The following example was carried out with a spinning head similar to that illustrated in FIG. 4. The inclined guide plate had been omitted.

The essential part of the spinning head is a spinneret whose length is 402 mm., its width being 182 mm. and its height being 42 mm. 634 openings having a diameter of 0.250 mm. are arranged at equally spaced intervals of 6 mm., each of these openings possessing a counter bore-hole having a diameter of about 3.0 mm. The length of the spinning openings is about 0.400 mm., that of the counter bore-holes about 18 mm. The central feed slot has a length of 259 mm. and a width of 3.5 mm. Spinning nozzles are inclined on both sides of and directly adjacent to the feed slot, the angle $\alpha$ being 19°. The measurements of these spinning nozzles are the same as those of the other spinning openings.

A poly-ε-caprolactam melt is spun through the openings and spinning nozzles at a temperature of about 270° C, the delivery rate being 1.080 g./min.

A metallic screen similar to that of FIG. **2*b*** consisting of warp and weft wires composed of steel and having a diameter of 0.45 mm. (the measurements of the mesh openings being 25 mm. × 25 mm.) is fed by two rolls from the supply reel through the central slot with a feeding rate of 2 m./min.

The freshly spun filaments and the metallic screen are disposited onto a water bath whose temperature is kept at 45° C. The gap between spinneret and bath surface is about 15 cm.

The so produced reinforced matting is vertically forwarded through the water bath and then drawn off to a take-up roll outside from the water bath. It has height of 40 mm., a bridth of 280 mm., a weight of 2.000 g./m.$^2$ and a strength of 25 kp per 25 cm length measured in a direction perpendicular to its running direction.

The invention is hereby claimed as follows:

1. A process for the production of a reinforced matting of melt-spun, interlooped, substantially amorphous and continuous synthetic thermoplastic polymer filaments which comprises:

conducting a continuous band of a flat, latticed structure as a reinforcing member downwardly into and then through a liquid cooling bath;

simultaneously melt-spinning a plurality of said thermoplastic polymer filaments downwardly toward said bath to form interlooped filaments adhering to each other at random overlapping points of intersection, said spinning taking place from at least two rows of spinning orifices disposed adjacently on either side of said reinforcing member;

applying at least part of the freshly spun filaments onto both sides of said reinforcing member by directing adjacent filaments on either side thereof at an angle inclined from the vertical direction to impinge upon and randomly penetrate said reinforcing member above the bath surface; and completely solidifying the freshly spun filaments only after their entry into said cooling medium such that in a bath zone near the surface of the cooling medium the filaments remain sufficiently tacky to adhere to each other at their overlapping points of intersection.

2. The reinforced matting product obtained by the process of claim 1.

3. A process as claimed in claim 1 wherein said filaments are spun from at least three rows of spinning orifices, including said two rows disposed adjacently on either side of said reinforcing member and at least one additional row spun vertically downwardly for direct deposit onto the bath surface, the upward buoyant force of the liquid cooling bath being sufficient to cause said filaments in said at least one additional row to spread laterally at the bath surface in the form of sinuous to helical loops overlapping each other with reference to adjacent filaments in at least the same row, the filaments of said at least one additional row being collected in said bath zone near the surface of the cooling medium for adherent contact with each other and with said filaments already applied to said reinforcing member.

4. The reinforced matting product obtained by the process of claim 3.

5. A process as claimed in claim 3 wherein the reinforcing member has a latticed structure with a mesh width of between about 10 and 30 mm., through which the adjacent filaments are directed from both sides in random penetration.

6. A process as claimed in claim 3 wherein the melt-spun filaments have a diameter of about 0.1 to 1.5 mm.

7. A process as claimed in claim 6 wherein the melt-spun filaments consist essentially of a poly-ε-caprolactam.

8. A process as claimed in claim 3 wherein said at least one additional row of sinuously to helically looped filaments are collected on a guide plate in said bath to deform at least one outermost row so that the individual loops therein project substantially parallel to said reinforcing member.

9. The reinforced matting product obtained by the process of claim 8.

10. A process as claimed in claim 1 wherein at least two rows of filaments are applied from only one side of said reinforcing member.

11. The reinforced matting product obtained by the process of claim 10.

12. Apparatus for the production of a continuous reinforced matting of melt-spun thermoplastic filaments comprising:

a spinning head mounted vertically above a cooling bath and having a central feed slot extending therethrough in the spinning direction to permit the passage of a latticed reinforcing sheet downwardly toward the bath surface;

means to conduct said reinforcing sheet continuously from a feed supply through said feed slot and into said cooling bath; and at least one row of spinning nozzles in said spinning head located on each side of and directly adjacent the feed slot, at least part of the nozzles in each row adjacent the feed slot being inclined at an angle of about 10° to 70° from the vertical to direct the melt-spun filaments onto the reinforcing sheet at a point above said bath surface under a force sufficient to permit loops of the filaments to penetrate the latticed structure of the sheet.

13. Apparatus as claimed in claim 12 in which there are two complete rows of said spinning nozzles inclined toward the reinforcing sheet, said rows being oppositely disposed on either side of the central slot to direct the melt-spun filaments in a converging path onto the reinforcing sheet conducted therebetween.

14. Apparatus as claimed in claim 13 in which the spinning head has at least one additional row of spinning nozzles to direct melt-spun filaments vertically downwardly onto the bath surface.

* * * * *